US008155358B2

(12) United States Patent
Park et al.

(10) Patent No.: US 8,155,358 B2
(45) Date of Patent: Apr. 10, 2012

(54) METHOD OF SIMULTANEOUSLY ESTABLISHING THE CALL CONNECTION AMONG MULTI-USERS USING VIRTUAL SOUND FIELD AND COMPUTER-READABLE RECORDING MEDIUM FOR IMPLEMENTING THE SAME

(75) Inventors: Youngjin Park, Daejeon (KR); Sungmok Hwang, Daejeon (KR); Byoungho Kwon, Daejeon (KR); Hyun Jo, Daejeon (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 1114 days.

(21) Appl. No.: 12/017,244

(22) Filed: Jan. 21, 2008

(65) Prior Publication Data

US 2009/0169037 A1 Jul. 2, 2009

(30) Foreign Application Priority Data

Dec. 28, 2007 (KR) ..... 10-2007-0139600

(51) Int. Cl.
*H04R 5/00* (2006.01)
*H04R 5/02* (2006.01)

(52) U.S. Cl. ..... 381/310; 381/17

(58) Field of Classification Search ..... 381/1, 17, 381/18, 310, 311, 303
See application file for complete search history.

(56) References Cited

U.S. PATENT DOCUMENTS

| | | | | |
|---|---|---|---|---|
| 5,335,011 | A * | 8/1994 | Addeo et al. | 348/14.1 |
| 5,459,790 | A * | 10/1995 | Scofield et al. | 381/310 |
| 5,796,843 | A * | 8/1998 | Inanaga et al. | 381/17 |
| 6,072,877 | A * | 6/2000 | Abel | 381/17 |
| 6,624,841 | B1 * | 9/2003 | Buchner et al. | 348/14.1 |
| 6,850,496 | B1 * | 2/2005 | Knappe et al. | 370/260 |
| 7,203,327 | B2 * | 4/2007 | Kubota | 381/310 |
| 2005/0147261 | A1 * | 7/2005 | Yeh | 381/92 |

* cited by examiner

*Primary Examiner* — Lincoln Donovan
*Assistant Examiner* — Alexander Talpalatskiy
(74) *Attorney, Agent, or Firm* — Allen, Dyer, Doppelt, Milbrath & Gilchrist, P.A.

(57) ABSTRACT

Disclosed herein is a method of simultaneously establishing the call connection among multi-users using a virtual sound field, in which when a plurality of users simultaneously make a video-telephone call to each other they can feel as if they conversed with each other in a real-space environment, and a computer-readable recording medium for implementing the same. The method comprises the steps of: a step of, when voice information is generated from any one of the plurality of speakers, separating image information, the voice information and position information of the speaker whose voice information is generated; a step of implementing the virtual sound field of the speaker using the separated position information of the speaker; and a step of displaying on the screen a result obtained by adding the implemented virtual sound field and the separated image information of the speaker together, and outputting the virtual sound field of the speaker through loudspeakers.

8 Claims, 5 Drawing Sheets

METHOD OF SIMULTANEOUSLY ESTABLISHING THE CALL CONNECTION AMONG MULTI-USERS USING VIRTUAL SOUND FIELD AND COMPUTER-READABLE RECORDING MEDIUM FOR IMPLEMENTING THE SAME

BACKGROUND OF THE INVENTION

1. Field of the Invention

The present invention relates to a method of simultaneously establishing the call connection among multi-users using a virtual sound field and a computer-readable recording medium for implementing the same, and more particularly to such a method of simultaneously establishing the call connection among multi-users using a virtual sound field, in which when a plurality of users simultaneously make a video-telephone call to each other they can feel as if they conversed with each other in a real-space environment, and a computer-readable recording medium for implementing the same.

2. Background of the Related Art

A portable terminal is increasing in number owing to its convenience of communication between end users irrespective of time and place. Along with the technological development of such a portable terminal, there has been the advent of an era enabling from the exchange of voice and data to further transmission and reception of video data during a telephone call. In addition, it is possible to establish a video-telephone call between multi-users as well as a one-to-one video-telephone call.

During such a video-telephone call among the multi-users, all the voices of multi-speakers in a conversation are heard on a one-dimensional direction regardless of the positions of the speakers whose image signals are transmitted. Also, in case where multiple speakers simultaneously converse with one another, voices of the multiple speakers are heard at once so that there frequently occurs a case where it is difficult to discern which speaker talks about which subject.

If a person talks with strangers during a video-telephone call, there occurs a case not capable of discerning which speaker talks about which subject due to their unfamiliar voices to thereby result in any confusion.

In case of a video-telephone call using a portable terminal or a computer, if voices of speakers are heard as if they talked to each other in a real-space environment, such confusion will be reduced. However, it is impossible to implement reality of conversation like in a real-space environment during a video-telephone call according to the prior art.

The core mechanism of recognizing the source location of the human voice is a head related transfer function (HRTF). If head related transfer functions (HRTFs) for the entire region of a three-dimensional space are measured to construct a database according to the locations of sound sources, it is possible to reproduce a three-dimensional virtual sound field based on the database.

The head related transfer function (HRTF) means a transfer function between a sound pressure emitted from the sound source in a arbitrary location and a sound pressure at the eardrums of human beings. The value of the HRTF varies depending on azimuth and elevation angle.

In case where the HRTF is measured depending on azimuth and elevation angle, when a sound source which is desired to be heard at a specific location is multiplied by an HRTF in a frequency domain, an effect can be obtained in which the sound source is heard at a specific angle. A technology employing this effect is a 3D sound rendering technology.

A theoretical head related transfer function (HRTF) refers to a transfer function $H_2$ between a sound pressure $P_{source}$ of the sound source and a sound pressure $P_t$ at the eardrum of human being, and can be expressed by the following Equation 1:

$$H_2 = \frac{p_t}{p_{source}}. \quad \text{[Equation 1]}$$

However, in order to find the above transfer function, the sound pressure $P_{source}$ of the sound source must be measured, which is not easy in an actual measurement. A transfer function $H_1$ between a sound pressure $P_{source}$ of the sound source and a sound pressure $P_{ff}$ at a central point of the human head in a free field condition can be expressed by the following Equation 2:

$$H_1 = \frac{p_{ff}}{p_{source}}. \quad \text{[Equation 2]}$$

Using the above Equations 1 and 2, a head related transfer function (HRTF) can be expressed by the following Equation 3:

$$H = \frac{H_2}{H_1} = \frac{p_t}{p_{ff}} \quad \text{[Equation 3]}$$

As in the above Equation 3, the sound pressure $P_{ff}$ at a central point of the human head in a free field condition and the sound pressure $P_t$ at the eardrum of human being are measured to obtain a transfer function between the sound pressure at a central point of the human head and the sound pressure on the surface of the human head, and then a head related transfer function (HRTF) is generally found by a distance correction corresponding to the distance of the sound source.

SUMMARY OF THE INVENTION

Accordingly, the present invention has been made to address and solve the above-mentioned problems occurring in the prior art, and it is an object of the present invention to provide a method of simultaneously establishing the call connection among multi-users using a virtual sound field, in which the virtual sound field is implemented using a head related transfer function (HRTF) during a simultaneous video-telephone call among a plurality of users to thereby increase reality of conversation between users, and a computer-readable recording medium for implementing the same.

To accomplish the above object, according to one aspect of the present invention, there is provided a method of simultaneously establishing a video-telephone call among multi-users using a virtual sound field wherein a screen of a portable terminal or a computer monitor is divided into a plurality of sections to allow a user to converse with a plurality of speakers during the video-telephone call, the method comprising the steps of: a step of, when voice information is generated from any one of the plurality of speakers, separating image information, the voice information and position information of the speaker whose voice information is generated; a step of implementing the virtual sound field of the speakers using the separated position information of the speakers; and a step of displaying on the screen a result obtained by adding the implemented virtual sound field and the separated image information of the speaker together, and outputting the virtual sound field of the speakers through a loudspeakers.

Preferably, the step of implementing the virtual sound field may further comprise: a step of selecting a head related transfer function corresponding to the position information of the speaker from a predetermined head related transfer function (HRTF) table; and a step of convolving the selected head related transfer function with a sound signal obtained from the voice information of the speaker to thereby implement the virtual sound field of the speaker.

Also, preferably, the predetermined head related transfer function (HRTF) table may be implemented by using both azimuth and elevation angle or by using azimuth angle only.

Further, preferably, in the step of implementing the virtual sound field, if the number of speakers is two, the virtual sound fields of the two speakers may be implemented on a plane in such a fashion as to be symmetrically arranged.

Also, preferably, in the step of implementing the virtual sound field, if the number of speakers is three, the virtual sound fields of the remaining both speakers may be implemented on a plane in such a fashion as to be symmetrically arranged relative to one speaker.

Moreover, preferably, the virtual sound signal may be output to be transferred to the user through an earphone or at least two loudspeakers.

In addition, preferably, the virtual sound field may be implemented in a multi-channel surround scheme.

According to another aspect of the present invention, there is also provided a computer-readable recording medium having a program recorded therein wherein a screen of a portable terminal or a computer monitor is divided into a plurality of sections to allow a user to converse with a plurality of speakers during the video-telephone call, wherein the program comprises: a program code for determining whether or not voice information is generated from any one of the plurality of speakers; a program code for separating image information, the voice information and position information of the speaker whose voice information is generated; a program code for implementing a virtual sound field of the speakers using the separated position information of the speakers; and a program code for displaying on the screen a result obtained by adding the implemented virtual sound field and the separated image information of the speaker together, and outputting the virtual sound field of the speakers through loudspeakers.

Further, preferably, the program code for implementing the virtual sound field may further comprise: a program code for selecting a head related transfer function (HRTF) corresponding to the position information of the speaker from a predetermined head related transfer function (HRTF) table; and a program code for convolving the selected head related transfer function with a sound signal obtained from the voice information of the speaker to thereby implement the virtual sound field of the speaker.

Also, preferably, in the program code for implementing the virtual sound field, if the number of speakers is two, the virtual sound fields of the two speakers may be implemented on a horizontal plane in such a fashion as to be symmetrically arranged.

Moreover, preferably, in the program code for implementing the virtual sound field, if the number of speakers is three, the virtual sound fields of the remaining both speakers may be implemented on a horizontal plane in such a fashion as to be symmetrically arranged relative to a virtual sound field of one speaker.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
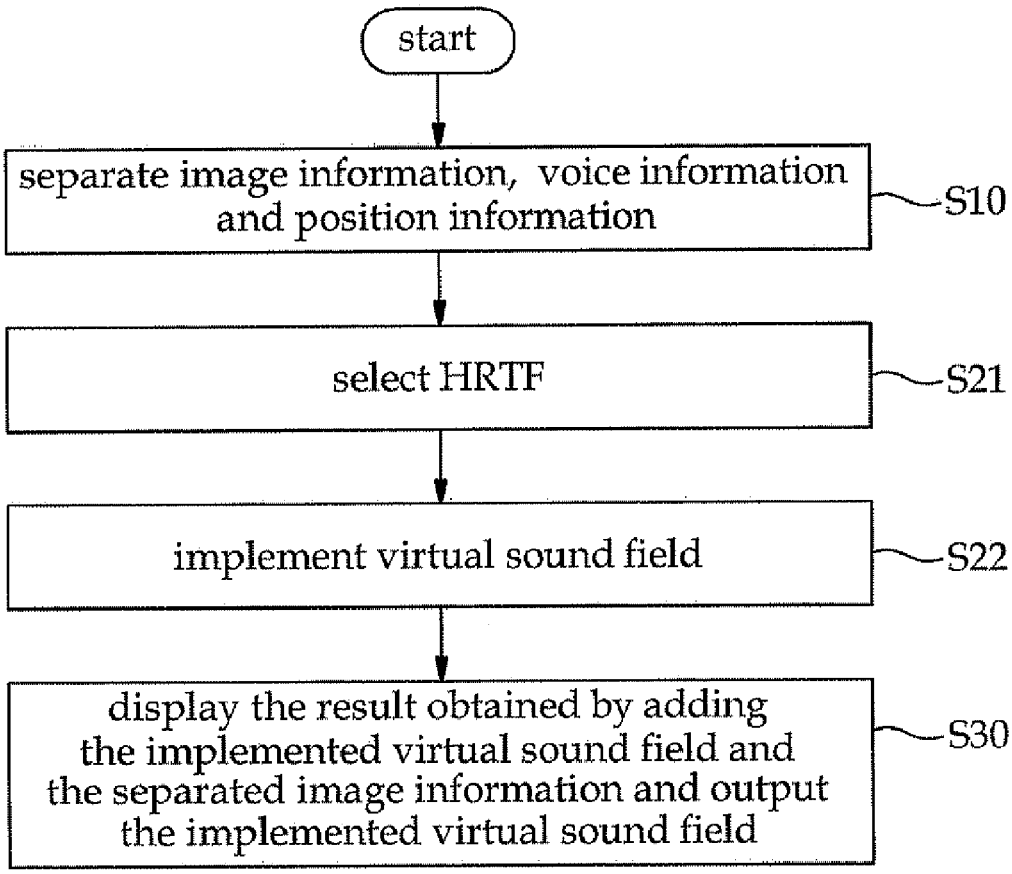
FIG. 1 is a flowchart illustrating a method of simultaneously establishing a video-telephone call among multi-users using a virtual sound field according to the present invention.

Reference will now be made in detail to the preferred embodiment of the present invention with reference to the attached drawings.

Throughout the drawings, it is noted that the same reference numerals will be used to designate like or equivalent elements although these elements are illustrated in different figures. In the following description, the detailed description on known function and constructions unnecessarily obscuring the subject matter of the present invention will be avoided hereinafter.

FIG. 1 is a flowchart illustrating a method of simultaneously establishing a video-telephone call among multi-users using a virtual sound field according to the present invention.

Referring to FIG. 1, there is shown a method of simultaneously establishing a video-telephone call among multi-users using a virtual sound field wherein a screen of a portable terminal or a computer monitor is divided into a plurality of sections to allow a user to converse with a plurality of speakers during the video-telephone call. The method comprises the steps of: a step (S10) of, when voice information is generated from any one of the plurality of speakers, separating image information, the voice information and position information of the speaker whose voice information is generated; a step (S20) of implementing the virtual sound field of the speaker using the separated position information of the speaker; and a step (S30) of displaying on the screen a result obtained by adding the virtual sound field and the separated image information of the speaker together, and outputting the virtual sound field of the speakers through a loudspeakers.

The step (S20) of implementing the virtual sound field further comprises: a step (S21) of selecting a head related transfer function corresponding to the position information of the speaker from a predetermined head related transfer function (HRTF) table; and a step (S22) of convolving the selected head related transfer function with a sound signal obtained from the voice information of the speaker to thereby implement the virtual sound field of the speaker.

When a user starts a video-telephone call using his or her portable terminal or computer, image information on each speaker is displayed on an LCD screen of the portable terminal or computer, which is divided into a plurality of sections. In this case, when voice information is generated from any one of the plurality of speakers, the user's portable terminal or computer receives image information, voice information and position information of the plurality of speakers and separate them (S10). Then, a head related transfer function corresponding to the position information of the speaker is selected from a predetermined head related transfer function (HRTF) table previously stored in a storage means (S21). At this time, the head related transfer function (HRTF) table is stored in a storage means such as a hard disk of the computer, and is set to be discerned depending on the position information (for example, variables such as azimuth angle, elevation angle, etc.) of each speaker.

The selected head related transfer function is convolved with a sound signal obtained from the voice information of the speaker to thereby implement a virtual sound field corresponding to each speaker (S22).

A result obtained by adding the implemented virtual sound field and the separated image information of the speaker together is displayed on the screen, and a sound signal is output through loudspeakers so as to be heard in a designated direction according to the position of the speaker (S30).

Also, the predetermined head related transfer function (HRTF) table can be implemented by using both azimuth and elevation angle or by using azimuth angle only.

For instance, only horizontal positions are used to implement the head related transfer function (HRTF). In case of implementing the head related transfer function (HRTF) table on horizontal plane, a head related transfer function (HRTF) data may be used as it is, in the step (S20) of implementing the virtual sound field. Alternatively, the virtual sound field may be implemented using only an interaural time difference (ITD) and an interaural level difference (ILD) in the head related transfer function (HRTF). The interaural time difference (ITD) refers to a difference in the time at which a sound emitted from a sound source at a specific location reaches two ears of the user with respect to the sound position. The interaural level difference (ILD) refers to a difference (absolute value) in the sound pressure level between two ears of the user where a sound emitted from a sound source at a specific location reaches with respect to the sound position. In case of using the interaural time difference (ITD) and the interaural level difference (ILD), since a process of convolution between the sound signal and the head related transfer function (HRTF) is not needed, it is possible to efficiently implement the virtual sound field using a small quantity of calculation.

Besides the azimuth angle of a speaker displayed on the screen, an elevation angle is used to implement the head related transfer function (HRTF) table on the three-dimensional space.

The present invention can be applied to all the fields enabling a video-telephone call among multi-speakers as well as a portable terminal or a computer to thereby enhance reality of conversation during the video-telephone call.

The head related transfer function (HRTF) table listed below, i.e., Table 1 shows that a virtual sound field for three speakers are exemplarily implemented on a horizontal plane.

TABLE 1

| | Elevation angle | | |
|---|---|---|---|
| Azimuth angle | −60° | 0° | 30° |
| −60° | | A | |
| 0° | | B | |
| 60° | | C | |

* In the azimuth angle, −60° denotes that when an LCD screen of a portable terminal is divided into two sections, a speaker is positioned at a left section of the LCD screen, and 60° denotes that a speaker is positioned at a right section of the LCD screen.
* In elevation angle, 0° denotes that a speaker is positioned at the front of the LCD screen, −30° denotes that a speaker is positioned a lower section of the LCD screen, and 30° denotes that a speaker is positioned an upper section of the LCD screen.

First Embodiment

Figure 2A:
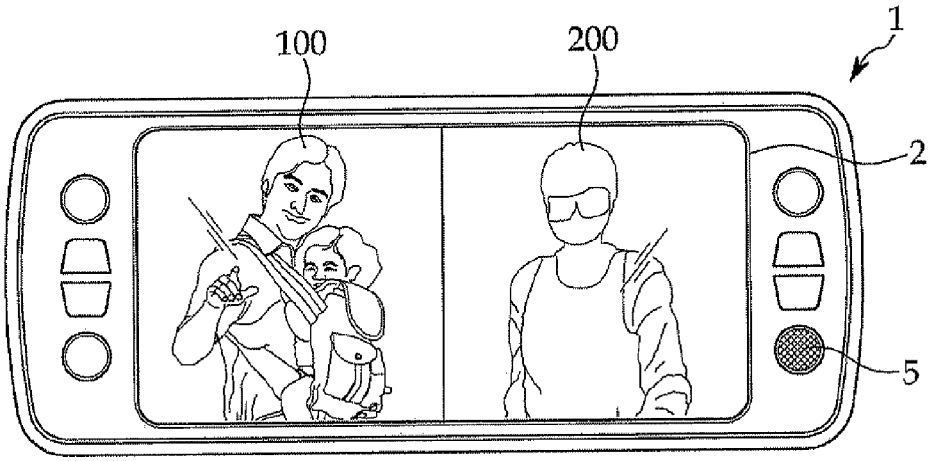
FIG. 2*a* is a pictorial view showing a scene in which a user converses with two speakers during a video-telephone call using a portable terminal.
Figure 2B:
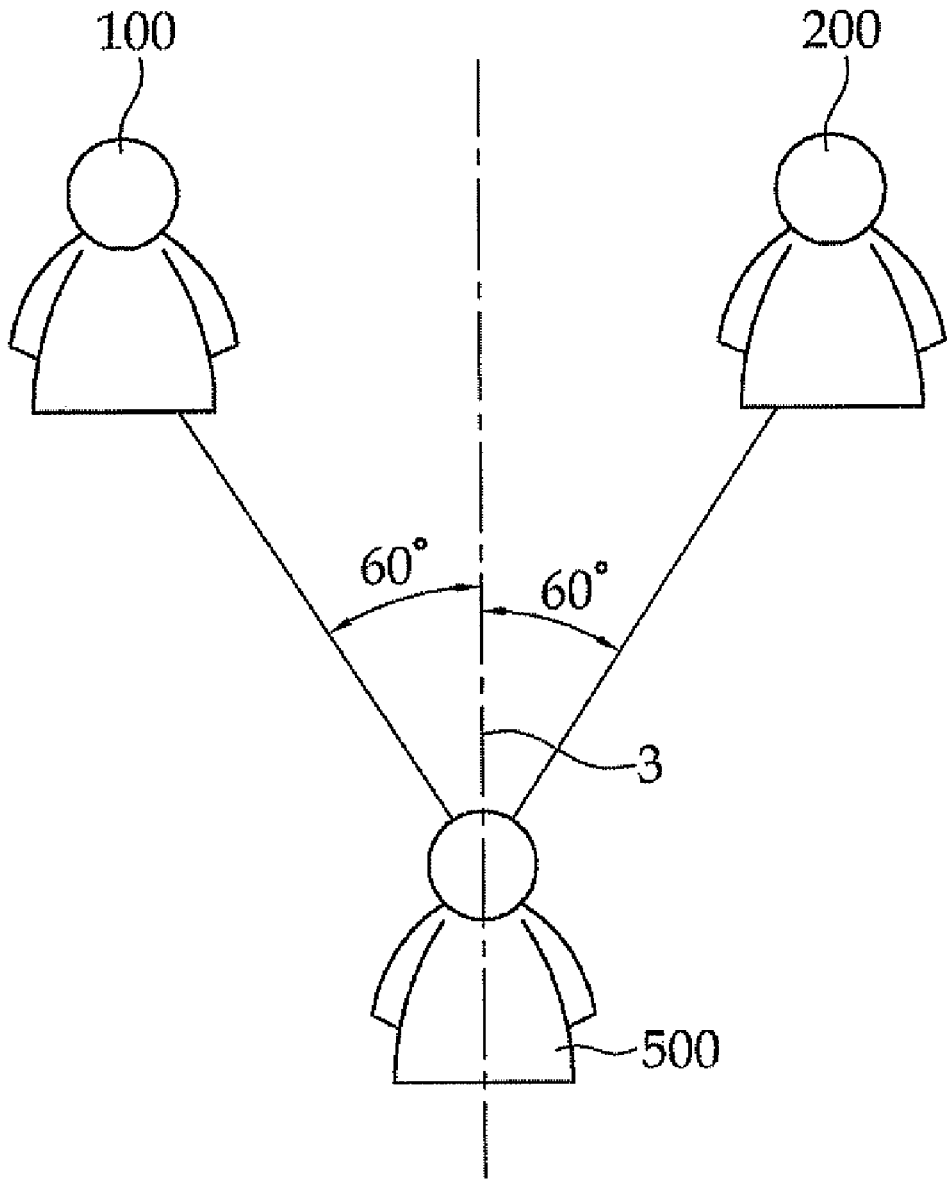
FIG. 2*b* is a schematic view showing a concept of FIG. 2*a;*

FIG. 2*a* is a pictorial view showing a scene in which a user converses with two speakers during a video-telephone call using a portable terminal, and FIG. 2*b* is a schematic view showing a concept of FIG. 2*a*.

The term "user" 500 as defined herein generally refers to a person who converses with a plurality of speakers during a video-telephone call.

As shown in FIGS. 2*a* and 2*b*, in case where a user simultaneously converse with two speakers during the video-telephone call using a portable terminal 1, an LCD screen 2 of the portable terminal 1 is divided into two sections to allow a first speaker 100 and a second speaker 200 to be positioned at the two sections. In this case, when voice information is generated from the first speaker 100, image information, the voice information and position information of the first speaker 100 are separated.

As shown in Table 1, when it is assumed that the azimuth angle of a reference line 3 is 0° relative to the user 500, the azimuth angle of the first speaker 100 is −60° and the azimuth angle of the second speaker 100 is 60°.

When the first speaker 100 starts to converse with the user to generate his or her voice information, since the first speaker 100 is positioned at a left side of the LCD screen 2, a virtual sound field of the first speaker 100 is implemented by selecting a value "A" corresponding to an azimuth angle of −60° in the head related transfer function (HRTF) table. That is, the selected head related transfer function "A" is convolved with a sound signal obtained from the voice information of the first speaker 100 to thereby implement the virtual sound field of the first speaker 100.

A result obtained by adding the implemented virtual sound field of the first speaker 100 and the separated image information of the first speaker together is displayed on the LCD screen of the portable terminal 1, and then the virtual sound field of the first speaker 100 is output to be transferred to the user 500 through a loudspeaker 5, so that the user 500 can feel as if he or she conversed with the first speaker 100 in a real-space environment, but not a telephone call environment.

In addition, when the second speaker 200 starts to converse with the user 500 to generate his or her voice information, since the second speaker 200 is positioned at a right side of the LCD screen 2, a virtual sound field of the second speaker 200 is implemented by using a value "C" corresponding to an azimuth angle of 60° in the head related transfer function (HRTF) table according to the position of the second speaker 200. The virtual sound fields of the first and second speakers 100 and 200 are implemented on a plane in such a fashion as to be symmetrically arranged.

Thus, the position of each of the first and second speakers positioned at the respective sections of the LCD screen and the position where the rendered sound emitted from the loudspeakers are identical to each other so that an effect can be provided in which the user feels as if he or she converses with a plurality of speakers in an real space environment.

Second Embodiment

Figure 3A:
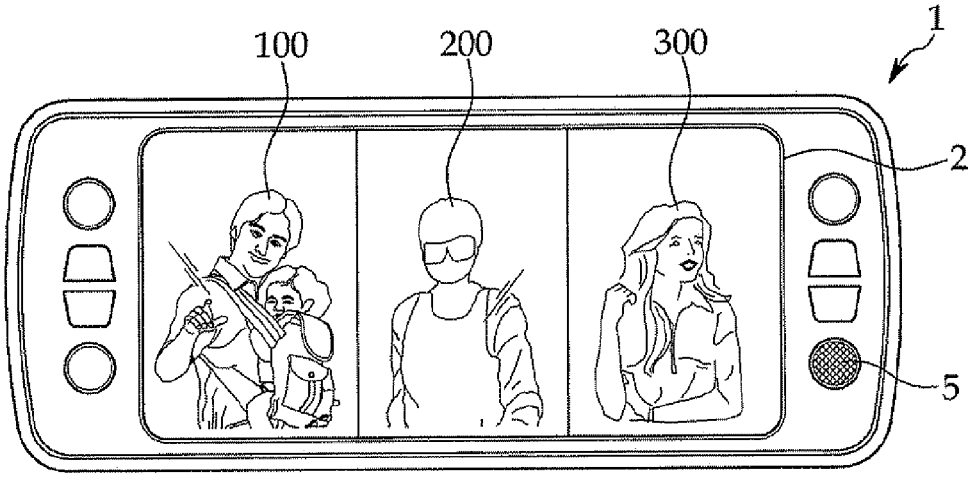
FIG. 3*a* is a pictorial view showing a scene in which a user converses with three speakers during a video-telephone call using a portable terminal.
Figure 3B:
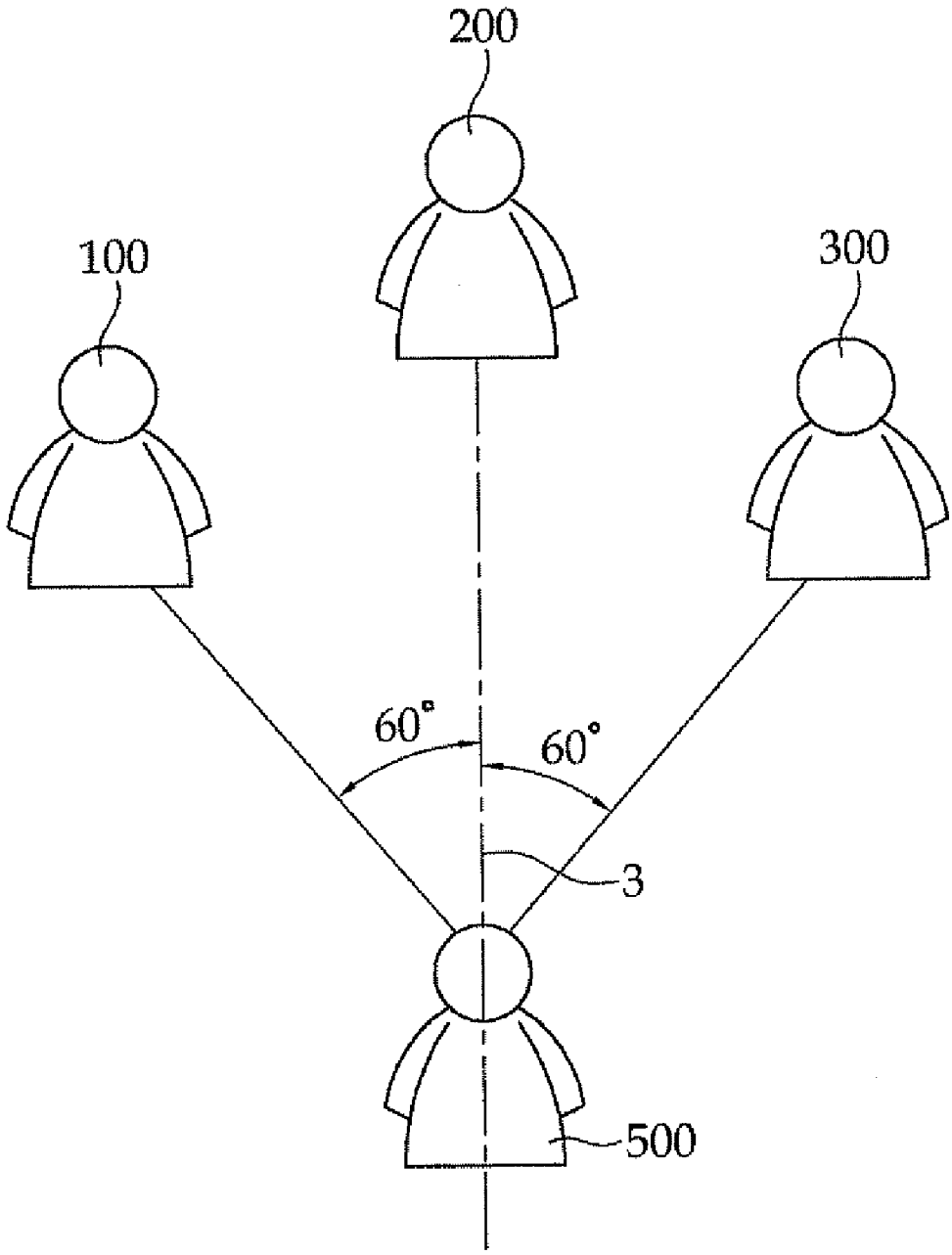
FIG. 3*b* is a schematic view showing a concept of FIG. 3*a*.

FIG. 3*a* is a pictorial view showing a scene in which a user converses with three speakers during a video-telephone call using a portable terminal, and FIG. 3*b* is a schematic view showing a concept of FIG. 3*a*.

As shown in FIGS. 3*a* and 3*b*, in case where a user simultaneously converse with three speakers during the video-telephone call using a portable terminal 1, an LCD screen 2 of the portable terminal 1 is divided into three sections to allow a first speaker 100, a second speaker 200 and a third speaker 300 to be positioned at the three sections in this order from the left side to right side of the LCD screen. In this case, when voice information is generated from the second speaker 200, image information, the voice information and position information of the second speaker 200 are separated.

As shown in Table 1, the azimuth angle of the first speaker 100 positioned at the left side of the LCD screen 2 is −60°, the azimuth angle of the second speaker 200 is 0°, and the azimuth angle of the third speaker 100 is 60°.

Like as the first embodiment, a virtual sound field of the second speaker 200 is implemented by selecting a value "B" corresponding to an azimuth angle of 0° in the head related transfer function (HRTF) table. The selected head related transfer function "B" is convolved with a sound signal obtained from the voice information of the second speaker 200 to thereby implement the virtual sound field of the second speaker 200.

A result obtained by adding the implemented virtual sound field of the second speaker 200 and the separated image information of the second speaker together is displayed on the LCD screen of the portable terminal 1, and then the virtual sound field of the second speaker 200 is output to be transferred to the user 500 through a loudspeaker 5, so that the user 500 can feel as if he or she conversed with the second speaker 200 in a real-space environment, but not a telephone call environment.

In addition, when the first speaker 100 starts to converse with the user 500 to generate his or her voice information, a virtual sound field of the first speaker 100 is implemented by using a value "A" corresponding to an azimuth angle of −60° in the head related transfer function (HRTF) table according to the position of the first speaker 100 on the LCD screen 2. Also, when the third speaker 300 starts to converse with the user 500 to generate his or her voice information, a virtual sound field of the third speaker 300 is implemented by using a value "C" corresponding to an azimuth angle of 60° in the head related transfer function (HRTF) table according to the position of the third speaker 300 on the LCD screen 2.

The virtual sound fields of the first and third speakers 100 and 300 are implemented on a plane in such a fashion as to be symmetrically arranged relative to the second speaker 200.

The virtual sound field implemented using the head related transfer function (HRTF) is output to be transferred to the user 500 through an earphone or at least two loudspeakers.

Moreover, the virtual sound fields of the speakers are implemented in a multi-channel surround scheme so that the user 500 can feel as if he or she conversed with the speakers in a real-space environment.

Further, the virtual sound field is not limited to the above scheme, but can be implemented using all the types of acoustic systems.

Thus, it is possible to execute the inventive method of simultaneously establishing a video-telephone call among multi-users using a virtual sound field, and the method can be recorded in a computer-readable recording medium.

The computer-readable recording medium includes an R-CD, a hard disk, a storage unit for a portable terminal and the like.

As described above, according to the present invention, when a simultaneous video-telephone call is made among multi-users using a portable terminal or a computer, image information and voice information of the speaker coincide with each other as if they conversed with each other in a real-space environment to thereby enhance reality of conversation.

Furthermore, since image information and voice information of the speaker on the screen coincide with each other, a speaker who is talking can be easily discerned only by the voice information.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A method of simultaneously establishing a video-telephone call among multi-users using a virtual sound field wherein a screen of a portable terminal or a computer monitor is divided into a plurality of sections to allow a user to converse with a plurality of speakers during the video-telephone call, the method comprising:

when voice information is generated from any one of the plurality of speakers, separating image information, the voice information and position information of the speaker whose voice information is generated;

implementing the virtual sound field of the speaker using the separated position information of the speaker; and displaying on the screen a result obtained by adding the implemented virtual sound field and the separated image information of the speaker together, and outputting the virtual sound field of the speaker through a loudspeaker;

wherein implementing the virtual sound field further comprises selecting a head related transfer function corresponding to the position information of the speaker from a predetermined head related transfer function (HRTF) table, and convolving the selected head related transfer function with a sound signal obtained from the voice information of the speaker to thereby implement the virtual sound field of the speaker.

2. The method according to claim 1, wherein the predetermined head related transfer function (HRTF) table can be implemented by using both azimuth and elevation angle or by using azimuth angle only.

3. The method according to claim 1, wherein the virtual sound field is output to be transferred to the user through an earphone or at least two loudspeakers.

4. The method according to claim 1, wherein the virtual sound field is implemented on a multi-channel surround speaker system.

5. A non-transitory computer-readable recording medium having a program recorded therein wherein a screen of a portable terminal or a computer monitor is divided into a plurality of sections to allow a user to converse with a plurality of speakers during the video-telephone call, wherein the computer-readable recording medium comprises computer executable instructions:

determining whether or not voice information is generated from any one of the plurality of speakers;

separating image information, the voice information and position information of the speaker whose voice information is generated;

implementing a virtual sound field of the speaker using the separated position information of the speaker; and displaying on the screen a result obtained by adding the implemented virtual sound field and the separated image information of the speaker together, and outputting the virtual sound field of the speaker through loudspeakers;

wherein implementing the virtual sound field further comprises selecting a head related transfer function (HRTF) corresponding to the position information of the speaker from a predetermined head related transfer function (HRTF) table; and convolving the selected head related transfer function with a sound signal obtained from the voice information of the speaker to thereby implement the virtual sound field of the speaker.

6. The non-transitory computer-readable recording medium according to claim 5, wherein the virtual sound field is implemented on a multi-channel surround speaker system.

7. The method according to claim 2, wherein the virtual sound field is implemented on a multi-channel surround speaker system.

8. The method according to claim 3, wherein the virtual sound field is implemented on a multi-channel surround speaker system.

* * * * *